United States Patent [19]

Hössle

[11] 4,051,007

[45] Sept. 27, 1977

[54] SACRIFICIAL ANODES FOR CATHODIC PROTECTION

[76] Inventor: Ludwig Hössle, Burgipfad 4, 1 Berlin 45, Germany

[21] Appl. No.: 620,104

[22] Filed: Oct. 6, 1975

[51] Int. Cl.[2] ..... C23F 13/00

[52] U.S. Cl. ..... 204/197; 204/148

[58] Field of Search ..... 204/148, 197

[56] References Cited

U.S. PATENT DOCUMENTS

| | | | |
|---|---|---|---|
| 2,157,180 | 5/1939 | Little | 204/197 |
| 2,517,382 | 8/1950 | Brinker et al. | 204/195 R |
| 2,710,833 | 6/1955 | Craver | 204/197 |
| 2,726,205 | 12/1955 | Marshall et al. | 204/197 |
| 3,423,305 | 1/1969 | Tausk | 204/197 |
| 3,513,082 | 5/1970 | Beer et al. | 204/148 |

*Primary Examiner*—T. Tung

[57] ABSTRACT

Sacrificial anodes for cathodic protection systems wherein inner portions of a tank, at least partly filled with a liquid, are exposed to a corrosive inner environment and are protected against the corrosion by the provision of a consumable sacrificial anode, the material of which gradually migrates through the liquid to and is deposited on the inner tank portions, without an external voltage being applied, and wherein the inner tank environment also promotes detrition of the sacrificial anode. The invention with the anode with an inner metal tube, provides openings in the tube wall, preferably by perforation, so that the anode material normally constitutes a barrier between the tube interior and the tank environment, and obtains an indication of progressed detrition or consumption of the anode, at which point the consumable anode should be replaced for continued effective cathodic protection. A pressure difference is usually effected between the tank environment and the tube interior, either by pressurizing the tank, or by providing a source of pressure or vacuum in the system. A small slidable plunger is provided that gives visual, color-coded information on the progressed detrition or consumption of the anode material inside the tank.

1 Claim, 6 Drawing Figures

SACRIFICIAL ANODES FOR CATHODIC PROTECTION

The invention relates to sacrificial anodes used for cathodic protection.

Known arrangements and anodes of this kind contain a body of anodic material having embedded therein a perforated metal tube, placed into a hermetically closed inner tank space. When the anode material is gradually consumed, as a result of its migration to the tank walls that act as the cathode, a signal indication can be obtained when the closed space reaches communication with the outside.

Such measures are not suitable to be used for automatically supervising and testing the integrity of the consumable sacrificial anodes, and particularly not in non-pressurized tanks, or when used in the soil. When the tank is not pressurized at all, so that only the static pressure of the medium or liquid is available, or if a pressure is available but small, e.g. as a result of an incomplete filling of the tank, there will be no indication or signalling, particularly at the end of a relatively long conduit that leads from the tank to an external test location.

The use of the known arrangements in the soil is not possible because the "medium" surrounding the sacrificial anode is the earth or soil itself, incapable of providing the pressure or pressure difference required by the prior-art arrangements, to signal the detrition of the anode material that surrounds the perforated tube.

For the cathodic protection of the outer walls or parts of sub-soil tanks, conduits and the like, so far one has placed a number of sacrificial anodes in the soil, at predetermined distances from each other and from the tank and the like to be protected. A single continuous or a collective conduit was used to interconnect the anodes with the tank to be protected. The soil itself constitutes in such arrangements the electrolyte. The testing of the anode integrity with such set-ups is not possible in an automatic fashion, but it is time consuming and cumbersome, particularly because each anode had to be uncovered (dug out) and inspected individually as to the degree of detrition by the cathodic effect.

If electrical measuring connections or leads are brought out from the anodes, they can only indicate the presently existing, and by computation the earlier voltage, without giving a clue to the impending perforation and consumption of the anode that will make its replacement necessary. To avoid the repeated unearthing of such anodes one has to rely on experimental data of average useful lifetimes, although there is always the danger that reliance on such average values alone might miss the already consumed condition of one or more anodes and/or the progressed corrosion of the tank and the like which is being observed.

It is one of the major objects of this invention to provide a sacrificial anode for cathodic protection which allows the surveillance of the anodes with simple expedients, even in non-pressurized tanks and in the soil, with an instantaneous indication of the detrition or partial consumption of the anode being tested, including long conduits or signal lines used therefor.

According to important, patentably distinct features of the invention, an indication of the progressed anode detrition is obtained, preferably at the free end of the metal tube inside the anode, led to an external test location, by providing continuous communication thereto from the tube interior, the indication being effective when the tank environment also reaches communication with the test location by way of at least one opening or perforation in the tube wall, when that opening becomes communicative as a result of the detrition of at least an adjacent portion of the sacrificial anode.

According to a further, optional feature of the invention, a pressure difference is effected between the inner tank environment and the interior of the metal tube inside the anode, the indication of the detrition taking place at the test location when the pressure difference equalizes through the at least one tube opening. Either a pressure source or a vacuum source can be applied, but it is also contemplated to attain the pressure difference by at least partly pressurizing the tank environment.

These expedients have the result that the pressure difference is obtained, for signalling purposes, regardless of the medium in which the sacrificial anode is being used. The anodic detrition results in the pressure difference which provides the alarm indication as explained earlier. The arrangement works also if there is no pronounced pressure in the tank, and/or if the sacrificial anode is embedded in the earth, from where it does not have to be removed for inspection as before. Long conduits will have no detrimental effect on the signalling procedure.

It is also within the scope of the invention to allow an applied external pressure to act on partly perforated openings, or on those that are close to being completely perforated, namely by mechanically destroying the remaining thin anode layer or portion in the vicinity of the particular opening. This bursting effect can be used advantageously to ascertain the impending perforation so that the sacrificial anode can be replaced before it has actually given a "perforated" signal indication. The application of a suitable pressure source to the outer tube end allows this optional step to be performed.

According to further important features of the invention, a metal core is used within the body of anodic material, including a metal bar and a metal tube having a portion embedded in the body and connected with the bar, wherein the embedded portion has an at least partly perforated wall, and a remaining portion of the tube projects from the other end of the body. The projecting portion has an imperforated wall, the body normally constituting a barrier between the interior of the tube and the tank environment. The latter reaches communication with the external test location by way of at least one of the perforations in the tube wall when it becomes communicative as a result of the progressed detrition of at least an adjacent portion of the anodic body.

The space constituted by the tube, that is, its internal space, is hermetically sealed from the space surrounding the sacrificial anode by the anodic material itself that surrounds and clads the tube, since the sieve-like perforations of the tube wall are covered or plugged by this material. If the anodic material is consumed by the anodic migration or detrition, then this hermetical closure no longer exists. This is used so that the state of the sacrificial anode can be monitored from outside with regard to its functional capability or its still remaining operating life. This is to say, if a pressure above normal atmosphere exists in the space surrounding the sacrificial anode or if a vacuum exists in the space formed by the tube, then, when the anodic material is consumed, a change in pressure takes place through the thus exposed perforation or perforations of the tube, which can be sensed by a pressure-measuring instrument (e.g. manometer) connected to the free end of the tube or by an electrical alarm system regulated by a hydraulic or pneumatic pressure switch.

It can also be assumed that, where there is a relatively large pressure upon the anodic material surrounding the tube or a relatively large pressure exerted from inside the tube, through the perforations, against the anodic material, the remaining weak resistant layer of the anodic material still remaining just before complete consumption will be broken inwards or outwards, as the case may be, consequently the instruments connected to the end of the tube do not simply indicate the complete consumption of the sacrificial anode but indicate when consumption is imminent. It is also possible, simply by using the tube projecting out of the anode, to provide a method of monitoring, if this tube extends out of the vessel or tanks. If the medium contained in the vessel escapes from the tube, then the sacrificial anode has been consumed.

When monitoring sacrificial anodes disposed in vessels, the end faces of the anodes from which the metal tubes project are preferably fitted with metallic closure caps, conductively connected to the anodic material and the metal tube in question, the outer contour of such a cap being formed as a screw thread with an adjoining sealing disk and, adjoining the latter, a four- or six-sided boss or head for receiving a spanner or the like tool. The metal tube projects centrally through a hole in this head, and the internal space of the cap, filled by the anodic material, has in the vicinity of the metal tube an annular bulge or the like, constituting an additional connection between the anodic material and the closure cap when the diameter of the anodic material becomes reduced as it is consumed as a result of its migration to the inner tank walls and the like.

By means of the closure cap, the sacrificial anode is screwed from outside in a pressure- and liquid-tight manner into the tank or vessel, the manhole cover or vessel end wall being removed once for the initial installation and being equipped at an appropriate searing position with a hole and a threaded sleeve welded into the hole.

After erection, the anode rod projects into the vessel and the metal tube out of the vessel. The anode rod may rest upon specially installed supporting components, which prevent bending of the anode rod due to its own weight. The projecting metal tube makes possible the connection of external monitoring devices, while the facility for screwing the sacrificial anode into the vessel wall also enables the anode to be replaced from outside. By means of such a device, all kinds of vessels that contain liquid media can be subjected to cathodic corrosion protection utilizing sacrificial anodes, while at the same time external monitoring or testing of the state of such anodes is made possible.

In pressure tanks or vessels for liquid media — such as heat exchangers, pressure-increasing plants and feedwater vessels — the operating pressure of the fluid in the vessel is utilized for monitoring the sacrificial anode or anodes disposed therein, which pressure acts upon both the vessel wall and the sacrificial anode, and causes the fluid to escape through the perforated metal tube as soon as the anodic material is consumed. The extent to which a still just existing residual layer of the anodic material would be penetrated by the fluid under pressure in the vessel, so that an advance indication of an imminent residue-free consumption of the anodic material can be effected, will depend upon the magnitude of the pressure of the fluid in the vessel.

In one form of construction as an automatically acting monitoring device, a pressure line, acting as an alarm line, is connected to the end of the metal tube that projects from the vessel, this line leading to an electrical alarm system. This system comprises a hydraulically or pneumatically operable device, which actuates an electrical change-over switch when the pressure-responsive device is subjected to a change of pressure communicated to the device via the alarm line.

In the normal operating setting of the alarm system, in which the change-over switch contact means is located in a first position, a specific indicator lamp is switched on permanently as an "operating indicator". When the movable contacts of the switch have been moved by actuation of the pressure-sensitive device to a second position in which a second lamp circuit is energized and the first lamp circuit is de-energized, the "operating indicator" is extinguished and another indicator lamp lights up as an "alarm indicator". The second lamp circuit may also be connected to an acoustic alarm device.

It will be understood by those skilled in the art that the "readiness" indicator does not have to go off when the "alarm" signal is given; the latter may be additional to the former.

For tanks or vessels which are not pressurized in operation, for example storage vessels for liquid media, the same automatically acting monitoring alarm system can be attached as for vessels which operate under pressure, but with the difference that in the alarm line a vacuum is induced and maintained by known means, this vacuum extending from the metal tube through the alarm line as far as the pressure- (or vacuum-) responsive switch actuating device. The latter is now designed in this case for the reverse method of operation. While the vacuum acts, it continuously maintains the switch contacts in such a position that the "operating indicator" is illuminated. When the anode rod becomes consumed and thereby the vacuum is broken as a result of the exposure of the perforations of the tube, the switch contacts are moved to the position in which the "alarm indicator" is operated.

For either type of vessel, i.e. pressurized and non-pressurized, it is further possible to provide a very simple manual monitoring device, by connecting a valve to the free end of the metal tube, thus making it easy to carry out a check by external inspection. If the fluid in the vessel drips or flows out when the valve is opened, this indicates that the sacrificial anode has been consumed to such an extent that it requires replacement.

It is also possible, with either type of vessel fitted with an automatically acting monitoring device, for a number of vessels to be connected by a common alarm line to the same alarm system. When an "alarm indication" occurs in this case, all the sacrificial anodes of all the vessels must be unscrewed for inspection, which can be easily done in a relatively short time by comparison with the earlier arrangements of sacrificial anodes.

It is also possible with pressure vessels, for the purpose of permanently monitoring sacrificial anodes, to mount a pressure-measuring device fixed on the metal tube, a method which appears favorable for example in large plants having a number of pressure vessels, which are often visted by operational personnel. It is also possible for such a device to consist solely of self-closing valves or the like mounted on each of the metal tubes, into which the inspecting person can insert a manual pressure meter for the purpose of checking the sacrificial anode. In this case also, it is possible for all vessels to be connected together by a common alarm line, leading to a single, central pressure-measuring device.

In a specific embodiment of the invention, it is possible not only to test the integrity and monitor the completed or the impending consumption of the sacrificial anode at a remote test location but safely to determine the time left up to the actual completion of the anode deterioration. As a basic consideration the invention is based in these respects on the recognition that a stronger anode material of the metal tube can withstand the pressure encountered on that tube more than can a weaker anode material. A pressure value which can safely be suffered by an unused sacrificial anode can constitute a "bursting value" if the anode material is half used up, a pressure suitable to destroy the remainder of the anode, at which time mechanical bursting occurs. On this basis a suitable concordance scale or range can be set up between the extremes "bursting pressure of unused sacrificial anode" and "zero pressure of entirely consumed anode", for the critical parameters "bursting pressure value" — "wall thickness" — "remaining operating time".

For the practical supervision and monitoring of cathodic protection systems and sacrificial anodes therein, the following application is envisaged by the present invention. A pre-requisite for the successful application of these considerations is a supervisional routine for each anode being installed, having an average operating lifetime of 15 years, establishing a particular time safety value for replacing the same, for example, by exchanging the partly consumed anodes at a point when 3 years of useful lifetime are still considered to remain. The pressure value at which an anode material can be made to burst when it has 3 more years to run is known from the earlier-mentioned concordance scale. According to the inventive process it is now possible to apply an overpressure of such a predetermined value, corresponding to that of the estimated 3 years of remaining operating time, for example by means of a transportable pressure source that can be linked to the metal tube of the sacrificial anode. If the tube bursts, as can readily be ascertained from a pressure drop resulting at the source or at an attached manometer, time has come to replace the sacrificial anode so as to insure continued effective cathodic protection. Otherwise the expected useful lifetime of the anode exceeds 3 years so that the pressure test can be repeated after some time.

If however the safety time period should be increased, with a somewhat earlier replacement of the anodes, it is of course possible to set the pressure source to the next higher value, such as for example 3.5 or 4 years, the application of which will either burst the anode material that clads the perforated tube, in which event the anode has to be replaced, or a longer remaining operating time has been proven by the applied routine test.

Such a testing method, strictly externally of the anodes, without physically inspecting them, can be applied for tanks that do or do not have any operating pressure therein. However if the tank has to operate under a certain pressure, the values of the applied concordance scale have to be increased by the value of the tank pressure, if the scale has been calibrated for non-pressurized tanks. It will be understood by those skilled in the art that various locally adaptable concordances can be set up, graphs and tables established on empirical data, and used in accordance with the just explained specific features of the present invention.

A self-closing, non-return valve can be interposed in the conduit between the anode and the remaining elements of the arrangement, including the pressure source which can be connected, in a conventional manner, by the intermediary of a suitable sleeve or cap or by simply pushing a connecting piece or tube into the free end of the valve.

When using the invention for monitoring the integrity of the outer surfaces of sub-soil tanks, conduits and the like, in which a plurality of sacrificial anodes is embedded in the soil at certain distances about the tank, it is possible to use both the automatic testing arrangement and the just described bursting procedure with the use of a pressure source. The arrangement, including one or more sacrificial anodes, can be connected to a single conduit or to a collective pipeline which leads to the sub-soil anodes, and is kept at a reduced pressure, as was mentioned in connection with the non-pressurized tanks. If the automatic alarm arrangement is not used, the under-pressure conduit can also be directly connected to a manometer.

When designing installations of underground sacrificial anodes, only short non-pressurized conduits are led out of the soil, of which similarly several can be connected to a common alarm circuit, to which a pressure source is attached when testing the integrity of the anodes. The inventive anodes, when used in the soil, do not necessarily have to be fitted with a closure cap and/or a threaded connection. However for purposes of reducing manufacturing costs, a unitary design can be adopted for all purposes, including closure caps for the anodes, preferably including sleeves by which the anodes can be secured in an opening in a wall portion of a tank, if attached to one. It should be noted that the lead-out conduits from the metal tubes are sufficiently stabilized and supported by the surrounding soil, both in respect of their own position and at the connecting points with the indicating or alarm conduits.

The earlier-described embodiment, for use with tanks that are pressurized or non-pressurized at will, having merely a valve at the end of the metal tube or the conduit attached thereto, for controlling the consumption of the anode, can also be made such that the free outflow of the liquid contained in the tank is prevented. Such an expedient can be provided or supplemented by using an inspection chamber, having a transparent window and the like, or a float in a closed chamber, in lieu of the earlier-mentioned self-closing valve.

When using a float in a closed chamber to act as a pressure-responsive member, the consumption of the anode becomes clearly visible. A liquid-drain valve may be fitted to chambers of this kind to allow the latter to be drained after the associated anode has been replaced, thereby to ready the arrangement for further monitoring and eventual indication when the new anode has also been consumed.

The application of a chamber with a float therein, in lieu of a valve, allows at least two possible uses of the arrangement in indicating the consumption of the sacrificial anode. If for example a transparent float chamber is used or one that has a transparent insert, the position of the float will itself give the necessary indication. The float consequently acts as an optical indicator which can be ready for visual observation at any time.

The chamber with its float can however also be built in that the raised condition of the float gives an alarm indication, by mechanical or electrical means. Here again an air-relief and/or a liquid drain valve can be provided in respective upper and lower portions of the chamber, for air and liquid discharge therefrom.

The invention also provides use of the sacrificial anode where a pressure-responsive switch is directly connected to the free end of the anode tube. The electrically operated alarm device can form a single unit with the switch, or it can be located at a remote point but connected with the switch by an electrical line.

As another important, optional feature of the invention, a liquid trap may be interposed in the conduit, which prevents any possibly entrained liquid from reaching the attached chamber, pressure-responsive member or other indicating device.

In all preceding embodiments of the invention the indicator is attached to the free end of the metal tube of the sacrificial anode. It is however also possible to combine the anode and the indicator into a single structural unit, thereby not only reducing manufacturing expenses but also allowing a very simple attachment to the tank and the like, furthermore dispensing with the use of qualified experts for the earlier-discussed arrangements.

In accordance with a specific, preferred sacrificial anode embodiment and cathodic protection arrangement according to the invention, a compact unit is provided where the test location is right at the end of the anode, having a chamber that communicates with the tube interior, and a slidable member in the form of a small plunger, with spring means for biasing the latter into a rearwardly, non-indicating rest position. If the anode is consumed and a pressure difference results, the plunger is moved against the biasing means into a forwardly indicating position.

A concave indicating chamber is provided in a closure-cap portion which has a light-reflecting inner wall, and wherein the plunger has a possibly cylindrical forward index pin portion, at least the envelope of this portion having a conspicuous color that becomes visible when the plunger has been moved to the forward indicating position, denoting the detrition of the sacrificial anode.

When non-pressurized tanks are involved, the just described specific embodiment can still be used by the application of an underpressure, namely by leading a small branch tube to the outer end of the metal tube or to the indicating chamber in the closure cap, for applying negative pressure to the system, resulting in a positive indication and forward movement of the plunger when the consumption of the connected sacrificial anode provides communication from the inner tank environment to the inventive indicating device.

It is well known that the gradual detrition or consumption of sacrificial anodes is not always uniform, even though the conditions within the tank and the testing or monitoring arrangement may be substantially the same. Should detrition be more pronounced in the area of the metal tube than in other areas, indication or signalling would occur much before the anode is actually consumed, a side effect that would not be economical, and would actually falsify the desired precise results.

For the above reason the invention provides a protection for the area of the anode in which the metal tube is located, to prevent premature detrition. In other words, it is contemplated that portions of the anode into which the tube does not extend should be used up first, so as to insure its maximum economical use, and increase its lifetime.

In a relatively simple manner, the invention provides this additional feature by a preferably tubular cover or sleeve applied to the outer periphery of the anode material or the cylindrical body constituted thereby, as a result of which detrition evidently starts on the non-covered surface areas, to proceed and extend to the covered portion after the used-up, substantially annular face starts to extend underneath the sleeve or cover. Such a cover is preferably made from a non-corrosive, for example plastic, material that will not migrate toward the cathode, constituted by the wall portions of the tank and the like.

Hitherto known sacrificial anodes have conventionally been produced by casting, including the cores constituted by metal bars that are embedded in the generally cylindrical bodies. This procedure would be technologically unjustified and uneconomical for the present invention. The invention therefore provides a simple manner of manufacturing the novel sacrificial anodes. In accordance with such additional aspects of the invention, the cylindrical anode body which has an iron core therein has the latter hydraulically pulled or pressed out of the unit by the length of the metal tube to be inserted. Thereafter a suitable adhesive or metal bond is introduced into the core aperture (or applied to the end of the tube), and then the partly perforated tube is hydraulically pushed into the aperture until it reaches a stop. The sacrificial anode is completed by cutting off the protruding core or bar portion so as to flush with the anode body.

Other objects and many of the attendant advantages of the invention, in all three of its major aspects, namely the method, the arrangement and the sacrificial anode itself, will be readily appreciated as the same becomes better understood by reference to the following detailed description, when considered with the accompanying drawing, wherein FIG. 1 is a longitudinal, partly sectional view of a basic embodiment of the inventive sacrificial anode;

Figure 1:
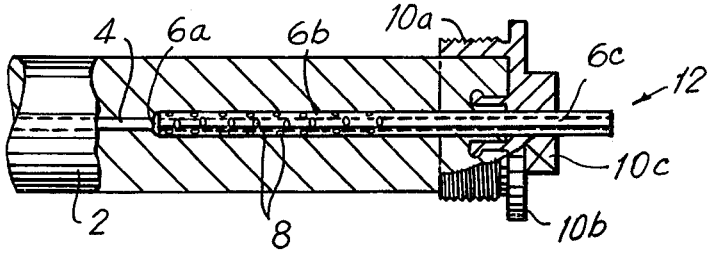

First the inventive sacrificial anode will be described with reference to FIGS. 1 and 2; the same or a similar construction may be used in the arrangement of FIG. 3, and to cooperate with the indicator portion shown in FIG. 4.

A body 2 of anodic material is shown, partly in section, including in the sectioned part an embedded metal bar 4 and, as a continuation of the latter, a metal tube which is identified with its various distinct portions, namely a perforated portion 6*b*, a smooth front end 6*c* which can extend out of the anode for connection to a conduit to be described later, and having a bore 6d therein; a weld 6a is shown at the tube end which joins the tube to the bar 4. This connection may be by way of welding, a suitable high-temperature and preferably non-corrosive glue, and the like. Only part of the embedded tube portion is perforated as shown at 8. It is important to note that the protruding portion 6c of the tube is not perforated.

As has been explained earlier, a plastic sleeve or jacket (not shown) may be applied to a portion of the body 2 of anodic material so as to slow down its detrition in that area, and to ensure foolproof operation, namely by allowing one of the perforations 8 to become communicative, and thereby to give an indication that the particular anode has been consumed to the extent of requiring replacement.

Figure 3:
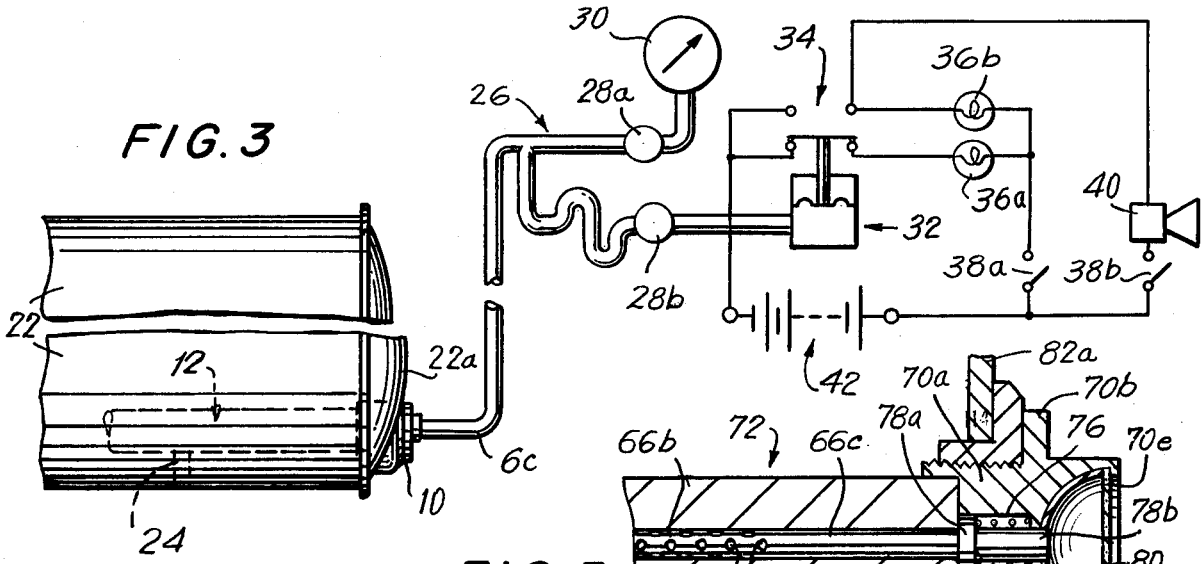
FIG. 3 is a somewhat schematic illustration of an arrangement for a cathodic protection, using one of the inventive sacrificial anodes and a pressure-sensitive membrane with a double alarm system operated thereby.

The free end 6c of the metal tube has an outwardly threaded flange part 10a thereabout, to facilitate attachment to a tank and the like (e.g. 22 as shown in FIG. 3); the flanged part continues as a skirt 10b and preferably has a front block portion 10c which may be hexagonal or otherwise suitable for being engaged with a tool when securing the sacrificial anode in a tank or conduit. In FIG. 3, the flange parts are designated by the overall numeral 10, and the anode by 12. For manufacturing convenience, an annular boss (not shown) may be included at the inner side of the flange 10.

Figure 2:
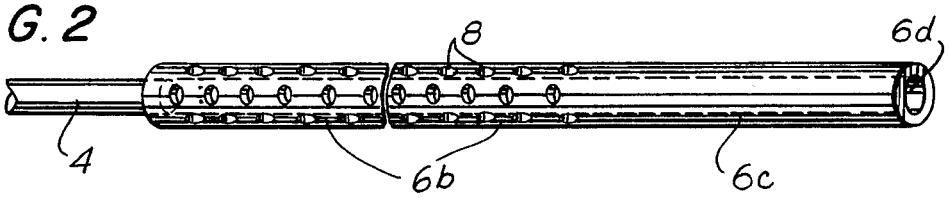
FIG. 2 illustrates in a perspective view an inner, partly perforated tube forming part of the anode of FIG. 1.

When first fitting out a tank 22 (FIG. 3) with one or more of the sacrificial anodes shown in FIG. 1, a manhole cover or, as shown, an end plate or lid 22a of the tank is removed, a hole is formed in it and the threaded flange part 10a welded or otherwise secured in the hole. At the same time, supporting components 24 may be mounted in the tank or vessel in correct orientation to the anode 12 and the threaded part 10a, for the anode to rest upon it or them after screwing into the tank so that they may prevent the anode from bending.

The front end 6c of the metal tube is optionally constructed to permit connection of a conduit 26 acting as an alarm line, of a pressure-sensitive device, of a pressure source (not shown) or of a valve. When the conduit is used as an alarm line for the automatic monitoring of pressurized tanks, non-pressurized tanks or sacrificial anodes buried in the ground, this lines leads at its other end to a pressure-responsive switch 32 and to an optional manometer or indicator 30. When a pressure rise, or a pressure drop, depending upon the construction, occurs in the conduit 26, the switch 32 actuates an electrical change-over switch 34, causing a signal lamp 36a of a permanent "operating indicator" to be switched off, and a signal lamp 36b, and optionally also an acoustic alarm device 40, to be switched on as an "alarm indicator". Switches 38a, 38b are included for optionally disconnecting either the lamps or the acoustic signal, depending on operating requirements.

Pressure generated within the vessel is in communication through the perforations 8 of the tube portion 6b with the conduit 26 and is propagated along the latter to the meter 30 and to the switch 32, 34, and moves the latter to its switched-over position. Where the alarm system is designed for unpressurized vessels or for buried sacrificial anodes, a constant vacuum is generated and maintained by known means (not shown) in the line 26, in which case the connection of such vacuum means may be effected, for example, via a valve 28b in the line 26, which valve may also serve as a water-drain valve for the alarm line system, behind an illustrated liquid trap. An optional valve 28a may be provided for the meter 30.

The pressure switch 32, with the underpressure arrangement, would operate in the reverse manner. So long as a vacuum exists, the "operating indicator" is switched on. When the vacuum diminishes due to a pressure rise in the vicinity of the perforated tube 6b, the switch returns to its lower position, and the "alarm indicator" is switched on. The electrical portion of the alarm system is connected to a conventional power source 42.

Figure 4:
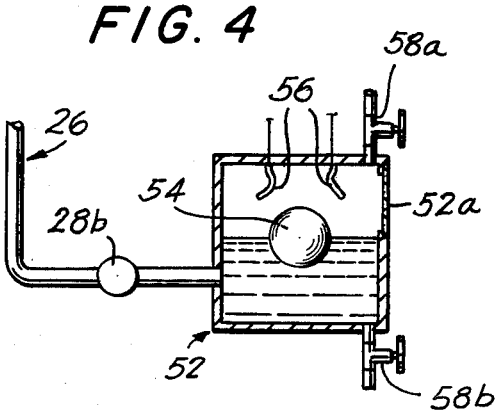
FIG. 4 is a sectional view of an alternative monitoring arrangement, including a float in a closed chamber.

Not to overcrowd the drawing, FIG. 4 shows only the indicator portion of the inventive arrangement, starting from the conduit 26 which has the valve 28b therein, followed by a float chamber 52 having therein a suitable float 54, an inspection window 52a being arranged in a wall of the chamber to allow the entrained liquid level to be observed. This could however be in the form of a sight glass and the like (not shown).

Alternatively, electrical contacts 56 may be provided at a suitable height above the float (which might be restrained in its lateral movement, in a conventional manner), to be connected to a switch circuit as was shown in FIG. 3 at 32, 34 and so on. These omitted details will be clear to those skilled in the art.

The chamber 52 may have an air-relief valve 58a, as schematically shown, and/or a liquid drain 58b, to be used when re-setting the arrangement for the next monitoring cycle, after the perforation of the metal tube inside the sacrificial anode gave positive indication of the anode detrition.

Figure 5:
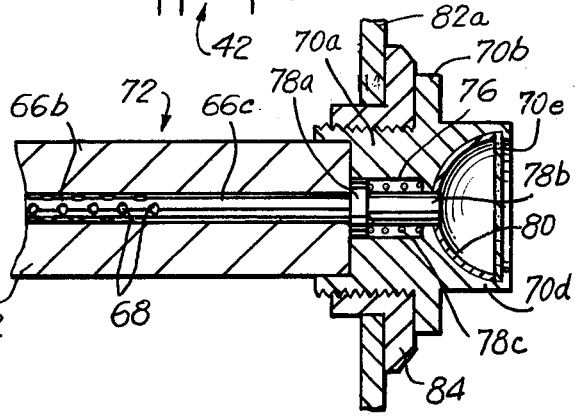
FIGS. 5, 6 are lengthwise sectional views through a specific anode embodiment which includes its own indicator, shown first in a non-actuated rest position and then in an actuated indicating position, with a small plunger protruding into a concave indicating chamber.
Figure 6:
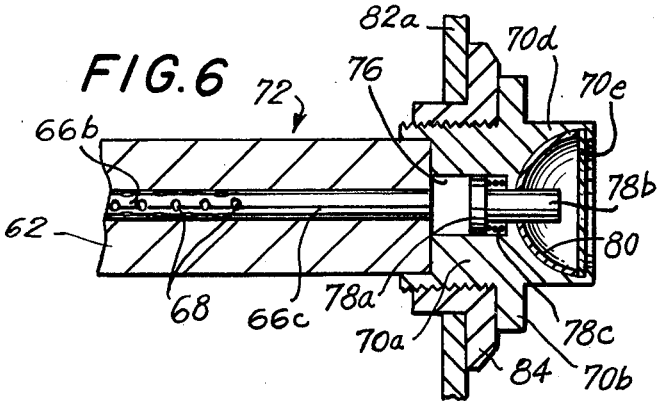

FIGS. 5 and 6 illustrate a specific, most useful embodiment of the inventive anode and arrangement, combined into one; the figures differ only in their respective showing of a non-actuated and an actuated or indicating position, after one of the perforations became communicative, as was described earlier.

The anode body is designated here by numeral 62 (corresponding to 2 of FIG. 1), tube portions are 66b, and -c, while perforations are designated 68. A somewhat different flange portion is shown at 70a, the skirt portion being 70b. The entire anode structure is designated by numeral 72. A packing 84 is shown between the anode structure and a wall portion 82a of a tank and the like (not further shown).

The anode flange is formed with a head designated 70d, covered in front by a small window 70e for purposes to be explained hereunder. The inner bore of the metal tube portion 66c leads to a small chamber or preferably axial recess 76 suitable to receive a slidable, air- and liquid-tight plunger therein, having a larger rear portion 78a and a narrower front or index pin portion 78b, as shown. A spring 78c and the like biases the plunger into its rearward rest position when there is no pressure coming from the anode.

The head 70d has a concave chamber therein, preferably with a mirrored i.e. light-reflecting, or shiny (silverish) rear wall 80; the tip of the plunger pin 78b may have the same color and will be substantially flush with wall 80 (see FIG. 5). However at least the outer envelope of the plunger portion 78b may have a conspicuous, e.g. red coat applied thereto, which becomes visible only when pressure acts on the plunger and moves it forward, into its indicating or "alarm" position. Owing to the concave arrangement of the front chamber and its mirrored rear wall 80 the observer will see all of this chamber "red", for "alarm", when the index pin of the plunger protrudes.

Such a compact anode and indicator arrangement allows ready monitoring of all anodes, without extensive conduits and other associated elements. Should one of these anode indicators become defective it is very easy to unscrew and replace the same (as long as the associated tank is not pressurized, or the pressure has been temporarily released).

It should be understood that only exemplary details and features have been shown, without varying and combining them as has been described, so that the exemplary illustrations should not be construed in any limiting sense. Thus, for example, particulars of FIG. 4 can be combined with those of FIG. 3; a pressure or a vacuum source can be attached in the described manner to any one of FIGS. 3 to 5, and so on. What is important is that a pressure difference be provided, positive or negative, to allow indication to derived of the completed detrition, which can be intentionally induced, as has been described earlier, when "bursting" an already weakened perforation.

It should be understood, in the customary manner, that the foregoing disclosure relates only to preferred, exemplary embodiments of the inventive method, arrangement and sacrificial anode, and that it is intended to cover all changes, modifications and combinations — as was mentioned earlier — which do not constitute departures from the spirit and scope of the invention as disclosed herein.

What I claim is:

1. A sacrificial anode for cathodic protection of inner portions of a tank and the like, at least partly filled with a liquid, which portions are exposed to a corrosive inner environment, to be protected against corrosion by the provision of the sacrificial anode that is consumed while its material gradually migrates through the liquid to and is deposited on the inner tank portions, in the absence of an external voltage being applied, and wherein the innter tank environment also promotes detrition of the sacrificial anode;

the latter comprising a generally cylindrical body of anodic material, the outer surface of which is exposed to the tank environment;

said body being provided with a metal core including a metal bar having a first end flush with one end face of said body and a metal tube having a portion embedded in said body and connected with said bar;

the embedded portion having an at least partially perforated wall;

a remaining portion thereof projecting from the other end face of said body, and said projecting portion of the tube having an imperforated wall;

said body normally constituting a barrier between the interior of said tube and the tank environment;

whereby the latter reaches communication with an external test location by way of at least one of the perforations in said tube wall when that perforation becomes communicative as a result of progressed detrition of at least an adjacent portion of said body, at which point the sacrificial anode should be replaced for continued effective cathodic protection;

a closure cap connected to said body and to said tube;

said closure cap having a first portion defining a first chamber that communicates with said tube interior;

a plunger, at least partly slidable in said chamber and sealingly engaging an inner wal of said first chamber with a portion thereof;

the movement of said plunger being responsive to the detrition of said body and as a result of a pressure difference being relayed thereto through said tube;

spring means in said first chamber and between a portion of said plunger and said inner wall of the first chamber for normally biasing said plunger into a rearwardly, non-indicating rest position toward said tube, while the pressure difference will move said plunger against said spring means into a forwardly indicating position;

a second portion of said cap defining an indicating second chamber having an at least partly light-reflecting concave inner wall;

said plunger including a forward index pin portion protruding from said first chamber;

said forward index pin portion being normally disposed substantially flush with said concave inner wall when in a non-indicating position;

at least the envelope of said forward index pin portion having a conspicuous color that becomes visible to an observer of said indicating chamber when said plunger has been moved to the forwardly indicating position beyond the reflecting surface of said concave wall, denoting the detrition of said body.

* * * * *

UNITED STATES PATENT OFFICE

CERTIFICATE OF CORRECTION

PATENT NO. : 4,051,007

DATED : September 27, 1977

INVENTOR(S) : Ludwig Hössle

It is certified that error appears in the above-identified patent and that said Letters Patent are hereby corrected as shown below:

In the Abstract, second column, line 7: change "with the" to -- provides the --; line 8: change "provides openings" to -- with openings --;

column 10, line 41: change "the skirt" to -- a skirt --;

in the heading, under [76]: the street address should be -- Bürgipfad 4 --.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*